US005223099A

United States Patent [19]

Salo

[11] Patent Number: 5,223,099

[45] Date of Patent: * Jun. 29, 1993

[54] EXTERNAL HEATING ARRANGEMENT FOR A PAPER WEB CERAMIC COATED ROLL IN A PAPER MACHINE

[75] Inventor: Jukka Salo, Jyvaskyla, Finland

[73] Assignee: Valmet Paper Machinery Inc., Finland

[ * ] Notice: The portion of the term of this patent subsequent to Aug. 14, 2007 has been disclaimed.

[21] Appl. No.: 805,027

[22] Filed: Dec. 11, 1991

Related U.S. Application Data

[63] Continuation-in-part of Ser. No. 708,519, May 31, 1991, abandoned, which is a continuation of Ser. No. 436,346, Nov. 13, 1989, abandoned.

[30] Foreign Application Priority Data

Nov. 15, 1988 [FI] Finland ..... 885283

[51] Int. Cl.[5] ..... D21F 5/00; D21F 3/08

[52] U.S. Cl. ..... 162/207; 100/38; 100/93 RP; 162/206; 162/359.1; 165/89

[58] Field of Search ..... 162/206, 207, 359, 359.1; 29/132, 130; 165/89; 100/38, 93 RP

[56] References Cited

U.S. PATENT DOCUMENTS

| | | | |
|---|---|---|---|
| 4,614,565 | 9/1986 | Riihinen | 100/93 RP |
| 4,631,794 | 12/1986 | Riihinen | 29/132 |
| 4,738,752 | 4/1988 | Busker et al. | 162/359 |
| 4,748,736 | 6/1988 | Miihkinen | 29/132 |
| 4,796,342 | 1/1989 | Miihkinen | 29/132 |
| 4,889,598 | 12/1989 | Niskanen | 162/206 |
| 4,948,466 | 8/1990 | Jaakkola | 162/207 |
| 5,070,587 | 12/1991 | Nakahira et al. | 29/132 |

FOREIGN PATENT DOCUMENTS

| | | | |
|---|---|---|---|
| 2002929 | 5/1990 | Canada . | |
| 0276203 | 7/1988 | European Pat. Off. | 162/359 |
| 2169381 | 7/1986 | United Kingdom | 29/132 |

*Primary Examiner*—Karen M. Hastings
*Attorney, Agent, or Firm*—Steinberg & Raskin

[57] ABSTRACT

The surface properties of a roll and/or rolls in a paper machine are affected by regulating the temperature of the roll face by means of an external heating device. In the arrangement, a combination of a heating device and a roll coating is used in such manner that the heating radiation penetrates through the paper or only directly to the roll face, but does not heat the roll itself at a depth greater than the roll face. The roll coating is preferably made of a dark, readily heatable and insulating material. The arrangement of the invention is utilized for example in a calendar and for detaching the paper from a roll.

12 Claims, 1 Drawing Sheet

EXTERNAL HEATING ARRANGEMENT FOR A PAPER WEB CERAMIC COATED ROLL IN A PAPER MACHINE

BACKGROUND OF THE INVENTION

This is a continuation-in-part application of U.S. patent application Ser. No. 7/708,519, filed May 31, 1991, now abandoned, which is a continuation of U.S. patent application Ser. No. 07/436,346, filed Nov. 13, 1989, now abandoned.

A number of different requirements are required on the rolls and roll faces in different parts of a paper machine, such as, for example, properties of durability, adhesion, transfer and detaching.

For example, in the so-called closed press sections, which are commonly used in paper machines, in connection with the center roll, one, or as a rule, several press nips are formed. An example of such a press section is the press section which is marketed under the trademark "Sym-Press II", which is shown in U.S. Pat. Nos. 4,209,361 and 4,285,766.

The smooth faced center roll in the press section, which is a roll of a larger diameter as compared with the other rolls, is usually made of rock, as a rule of granite. Since granite is a non-homogeneous natural material of low tensile strength, the use thereof in machine construction leads to considerable problems. If it is desired to heat a granite roll, its deformations dependent on temperature are non-linear and consequently difficult to predict.

Granite has relatively good properties of adhesion, transfer and detaching of the web, which are reasons for its popularity for use as a press roll material. The properties of detaching, however, require further improvement, particularly in the case to unbleached paper qualities.

As is known in the prior art, the web is detached by pulling it freely without support from the face of the center roll in the press. This free draw is quite critical in view of the operation of the paper machine. In the free draw, a difference in speed is used which extends the web, and this results in certain drawbacks.

Furthermore, the free draw forms a problematical point susceptible to breaks in the paper machine. In earlier times, the detaching was always carried out mechanically by pulling, and the heating took place in the roll body, resulting in the entire roll being hot. As a consequence, the roll becomes worn and the intervals between grindings became short. The free draw of the web has become an even more important problem because of ever increasing running speeds of paper machines, and because different paper qualities are often produced by a paper machine, with different adhesion to the face of the rock roll, resulting in variations in the necessary tension required for detaching of the web.

In U.S patent application Ser. No. 147,695, now U.S. patent application Ser. No. No. 4,889,598, corresponding to FI U.S. patent application Ser. No. 870308, a system of regulation is described wherein the detaching of the paper web from the smooth face of the center roll in a press can be better controlled. It is a particular object of the invention therein to provide such a system of regulation of the detaching of the web wherein the tension of detaching of the web can be set optimally irrespective of the dry solids content of the paper web, of the surface energy of the material, and of the running speed of the paper machine. The method on accordance with this application is characterized in that in the method the temperature of the face of the smooth faced press roll is regulated, and by means of this regulation, the adhesion between the roll face and the paper web to be detached is affected and as a result the detaching angle and/or the detaching tension of the paper web is/are set within an optimal range.

On the other hand, the device of the above application is mainly characterized in that in connection with the smooth faced press roll, heating devices are provided by means of which the temperature of which the smooth face of the press roll and thereby the detaching of the web from the roll face are affected.

Still further, the invention of the above application is based on the observation that the temperature at the interface between the paper web and the smooth roll face from which the web is to be detached effects the dry solids content of the web, the surface energies of the materials in contact and the viscosity of the water, which parameters again affect the adhesion between the paper web and the water contained therein, on the one hand, and the smooth roll face on the other hand.

By establishing the interdependence of these parameters, and by controlling the same and further, on the basis of this information, regulating the temperature of the roll face by means of the regulating system of the invention, it is possible to adjust the detaching tension of the paper web to a suitable level even within highly varying operating conditions. Thus, in the described invention, when running different paper qualities and with different running speeds of the paper machine, it is possible to adjust the temperature of the smooth face of the roll to a specific set value, which provides optimal detaching of the web and optimal running quality with the web quality and machine speed that is used at any particular time.

In the above described invention, the central roll of the press, or any other corresponding smooth faced roll from which the paper web is to be detached, is a substantially metal-mantle roll coated with a metal, with a ceramic material, or with mixtures of the same, or a cast iron roll, or an uncoated metal roll which are arranged to be heated by means of adjustable heating devices. The heating may take place from inside and/or outside the roll, at least partly by means of techniques known in the prior art.

The invention of the above patent application is not restricted for use in the detaching of the web from the central roll of closed press sections of paper machines alone, but the invention is also suitable and intended for controlling the detaching of the web from a smooth faced roll in a press in general, i.e. also from a roll other than a central roll.

Reference is also made as prior art to U.S. Pat. No. 4,889,598, corresponding to Finnish Patent Application No. 870309. According to this patent, the water present between the web and roll face is heated, preferably vaporized, locally, within the area of the detaching point, by means of heat applied, among other ways, to the roll mantle, this to detach the web from the roll face. Since, in accordance with this patent, work for the detaching of the web is carried out by vaporization, it is not necessary to extend the web to detach the web, which again permits a closed draw from the center roll in the press to the drying section, e.g. onto the drying wire.

SUMMARY OF THE INVENTION

It is accordingly a primary object of the present invention, to improve on the solutions achieved according to the Finnish Patent Application Nos. 870308 and 870309.

It is another object of the present invention to provide improved control of the detaching of the paper web from the smooth face of the center roll in the press, and also to provide a better system for the regulation of the detaching of the web.

It is another object of the present invention to further expand the field of application of the invention so that in each application of use, the detaching tension of the web can be optimally set irrespective of the dry solids contents of the paper web, of the surface energy of the material, and of the running speed of the paper machine.

It is yet another object of the present invention to expand the field of application so that the invention can also be used for modification of other surface properties beside the properties of detaching of the web.

As still a further object, the present invention seeks to provide suitable surface materials for use wherein a heating device outside the roll is used.

Other objects and advantages of the present invention will be apparent from a further reading of the specification and of the appended claims.

With the above and other objects in view, the apparatus in accordance with the invention comprises a combination of a heating device and a roll coating such that the heating radiation penetrates only through the paper or only directly to the roll face, but does not heat the roll itself at a depth greater than the roll face.

In accordance with the present invention, the combination of the coating and the heating is effected in such a manner that the dark surface of the surface material absorbs the light coming from the heating device in an efficient manner, so that the only roll face is heated and the inner part of the roll is not heated. Moreover, the coating material is chosen so that it acts as a thermal insulation, whereby the remainder of the roll is not heated and the heating power is not wasted.

The external heating device is advantageously a short wave infrared heater or a laser heater which is capable of heating the coating. The use of an infrared heater provides the advantage that the face can also be heated through the paper. Only a thin surface layer of the roll need be heated while the remainder of the roll remains at the temperature of the environment. Embodiments of suitable heaters are described in the above Finnish Patent Applications Serial Nos. 870308 and 870309.

BRIEF DESCRIPTION OF THE DRAWINGS

The background of the invention and certain of the exemplifying embodiments thereof will be described in greater detail below with reference to the accompanying drawings, in which.

DESCRIPTION OF PREFERRED EMBODIMENTS

Figure 1:
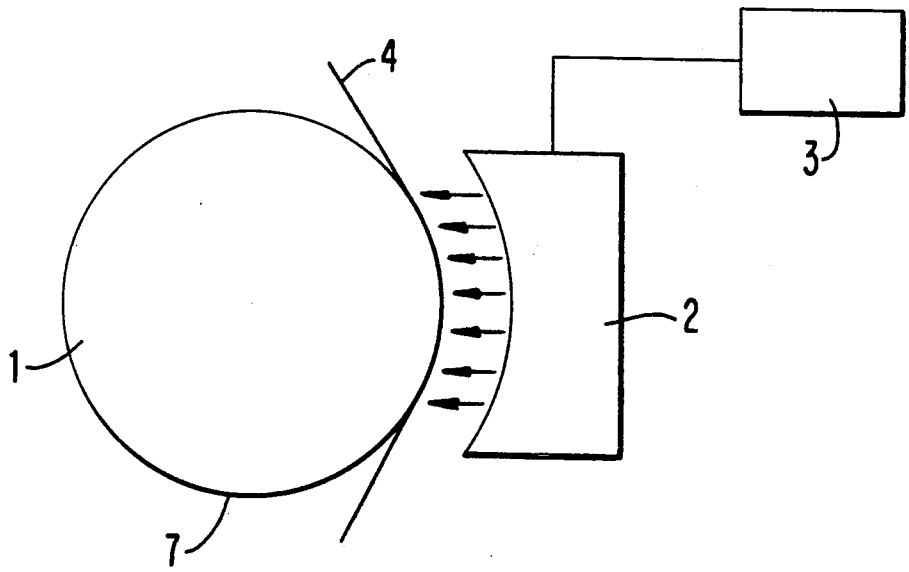
FIG. 1 is a schematic view of an arrangement showing infrared heating in accordance with the present invention.

As shown in FIG. 1, heat from an infrared heater 2, the energy of which is supplied by an energy source 3, passes through a paper web 4 and heats only the surface layer 7 of the roll 1. It is also possible to directly heat the surface layer 7 without the paper web over the same.

Figure 2:
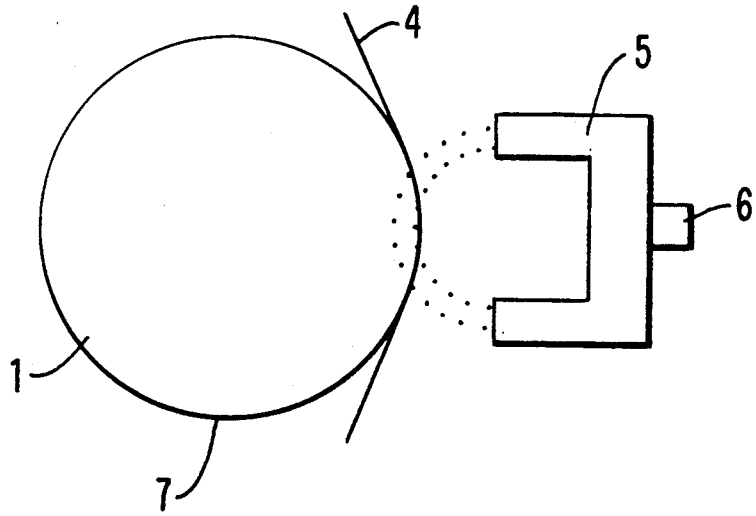
FIG. 2 is a schematic view showing inductive heating in accordance with the present invention.

As shown in FIG. 2, the same effect is achieved by inductive heating. The heat from the magnetic coil 5 supplied through coil 6 passes through the paper web 4 and heats only the surface layer 7 of the roll 1.

The surface layer 7 of the roll 1 is a coating, the purpose of which is to apply a thermal shock to the paper. The thermal shock can be utilized, for example, for drying the paper or for detaching the paper from the roll. Properties of this coating include dark face, good capacity of thermal insulation, good resistance to heat, good resistance to thermal shock, low coefficient of thermal expansion, high heat capacity, good wear resistance and/or good resistance to corrosion.

A suitable coating for this purpose is, for example chromia-silica composite, prepared by means of thermal spraying. It is an advantage of this material that it is dark, corrosion proof and wear resistant, and in accordance with the invention, the same is applied to various objects of use, for example, to a calendar.

Thus, as the roll coating, a dark readily heatable material is used which is sufficiently dark to absorb the light from the heating device. The final specific coating material in detail is chosen in accordance with the above described ultimate additional properties. The coating may, for example may be a ceramic or a ceramic composite or a mixture of a ceramic and a metal.

If hardness and wear-resistance is desired for the material, advantageously materials based on alumina ($Al_2O_3$) or chromia ($Cr_2O_3$) used. On the other hand, if heat resistance, impact strength and/or capacity of thermal insulation is/are desired for the material, advantageously materials are based on zirconia ($ZrO_2$) are chosen. In surface finish applications of high requirements, advantageously materials based on titania ($TiO_2$) are used. Coating materials can be used alone or in layers depending on the object of use, e.g. to provide a suitable resistance to thermal shocks or a capacity of thermal insulation.

One object of use in accordance with the invention is in a calendar roll, wherein the heating effect of the heating device penetrates through the paper, whereby the hot roll face modifies the surface properties of the paper. Suitable coating materials for this purpose are e.g. $Cr_2O_3$, $Al_2O_3$, $TiO_2$.

The thickness of the coating may be, e.g. 10$\mu$m to 10 mm, most appropriately about 50 $\mu$m to 150 $\mu$m.

In a preferred embodiment of the present invention, the coating is comprised of two layers. In this embodiment, an inner layer is provided from a suitable material having a low thermal conductivity compared to an outer layer of the coating. An example of a suitable coating in this embodiment would be, for example, a zirconia layer or equivalent used as a thermal insulation underneath a thin ceramic mantle.

More particularly, the rolls of the present invention comprise a roll face having a coating comprising an inner layer comprising $ZrO_2$, and an outer layer selected from the group consisting of $Al_2O_3$, $SiO_2$, $Na_2O$, $Fe_2O_3$, CaO, MgO, $TiO_2$, $Y_2O_3$, $Cr_2O_3$, and mixtures thereof, the coating having a sufficient thickness to provide thermal insulation to the roll such that heat from said external heating device heats the roll face without heating the roll to a depth greater than the roll face.

Zirconia ($Zr_2O_3$) is an especially preferred material to be used as the inner layer because the thermal conductivity of zirconia is only 0.99 K Cal/m hr° C. Thus, the thermal conductivity of zirconia is much lower than that of other suitable materials for use in the present invention, e.g., those materials listed in Table 1, infra.

In this preferred embodiment of the present invention, where the coating comprises two layers, it is preferred that the combined thickness of both layers (i.e., the thickness of the coating) is from about 100 to about 300 μm. More particularly, it is preferred that the inner layer of the coating has a thickness from about 50 to about 150 μm, and the outer layer has a thickness from about 50 to about 150 μm.

The invention may also be employed to detach the paper from the web by heating (by affecting the viscosity of the medium) or by vaporizing the interface, e.g. by vaporizing the water, in the case of a press roll, or the coating agent, in the case of a guide roll in a coating device. In other words, the arrangement can be used in a guide roll in a separate sizing cylinder to facilitate the scraping by means of a doctor, in which case the hot roll face vaporizes some of the size layer and detaches the paper from the roll. Coating materials suitable for this purpose include, e.g. $Cr_2O_3$.

An object of application may also be a pick-up roll wherein there is a felt between the paper and the roll.

In accordance with the invention, when it is desirable to obtain good adherence of the coating of the roll, increased toughness, and good wear-resistance of the coating at the same time in the coating material, it is possible to use a metal as an alloying agent, the ratio being, for example, 1 to 10–30 (metal to ceramic). One example of a coating might be a surface layer of WC 86 to 20 Cr4 isolated from the roll body by a layer of $Cr_2O_3$.

To manufacture a roll coating, it is possible to employ prior art processes, e.g. powder-metallurgic processes.

By means of the invention, a number of advantages are obtained over the prior art. It is thus possible, in accordance with the invention, to provide a wear-resistant face and at the same time, the detaching and other properties of the face can be modified very precisely in the desired way by means of the system of heating of the roll and by means of a suitable choice of materials.

Thus, the various objects of the invention are briefly detaching of paper from a roll by heating (by acting upon viscosity) or by vaporizing the interface, heating of the paper, and/or modifying the surface properties of the paper by the heating.

For these applications, short-wave radiation is suitable, the wavelength being e.g. 1 μm when the radiation is supposed to penetrate through the web (infrared heater); when the roll face is heated directly, a radiation of longer wavelength is suitable (infrared heater 1–5 μm, $CO_2$-laser 10.6 μm). The requirement of power depends on the web length, web thickness, web moisture, and on the filler material.

The following examples provided in Table 1 are given of materials suitable for use in accordance with the present invention. The scope of the invention is not, however, meant to be limited to the specific details of the examples.

TABLE 1

Examples of surface material compositions based on different oxides.

| Constituents | Ex. 1 (White Alumina) | Ex. 2 (Gray Alumina) | Ex. 3 (Alumina Titania) | Ex. 4 (Zirconia) | Ex. 5 (Yttria stabilizing Zirconia | Ex. 6. (Alumina Zirconia) | Ex. 7 (Titania) | Ex. 8 (Chromia) |
|---|---|---|---|---|---|---|---|---|
| $Al_2O_3$ | 99.64 | 96.06 | 58.29 | 0.45 | | 73.82 | 0.20 | 1.83 |
| $SiO_2$ | 0.10 | 0.60 | 0.13 | 0.40 | 0.12 | 0.10 | 0.12 | 6.23 |
| $Na_2O$ | 0.15 | | 0.15 | | | 0.02 | | |
| $Fe_2O_3$ | 0.03 | 0.40 | 0.04 | 0.13 | 0.03 | 0.06 | 0.40 | 0.30 |
| CaO | 0.04 | 0.12 | 0.02 | 5.51 | | | 0.03 | 0.45 |
| MgO | 0.04 | 0.12 | 0.01 | 1.43 | | | | 1.40 |
| $TiO_2$ | | 2.70 | 41.36 | 0.10 | 0.10 | 2.32 | 99.20 | |
| $ZrO_2$ | | | | 91.64 | 89.78 | 25.68 | | |
| $Y_2O_3$ | | | | | 9.97 | | | |
| $Cr_2O_3$ | | | | | | | | 89.50 |
| Thermal expans. coeff. $\times 10^{-16}$/°C. (20 . . . 1500° C.) | 7.4 | 7.6 | 7.8 | 9.5 | | | 5.0 | 5.0 |
| Thermal conductivity K Cal/m hr °C. | 2.36 (550 . . . 1100° C.) | | | 0.99 (550 . . . 1100° C.) | | | 2.98 (600° C.) | |

What is claimed is:

1. A method for controlling the surface properties of a roll in a part of a paper machine, comprising applying a coating to the face of a roll, the coating having an inner layer comprising $ZrO_2$ which functions as an insulating layer underneath an outer layer selected from the group consisting of $Al_2O_3$, $SiO_2$, $Na_2O$, $Fe_2O_3$, CaO, MgO, $TiO_2$, $Y_2O_3$, $Cr_2O_3$, and mixtures thereof, said coating having a sufficient thickness to provide thermal insulation to the roll, passing a paper web over the coated roll face, and heating said roll face directly or through the paper web in such a manner that only the roll face is heated without providing heat within the roll.

2. The method of claim 1, wherein said outer layer of said coating comprises $C_rO_3$.

3. The method of claim 1, wherein said outer layer of said coating comprises $Al_2O_3$.

4. The method of claim 1, wherein said outer layer of said coating comprises $TiO_2$.

5. The method of claim 1, further comprising heating said coated roll face by applying short wave infrared radiation from an external source.

6. The method of claim 5, further comprising heating said coated roll face by applying infrared radiation having a wavelength of 1 μm±0.5 μm when heating takes place through the paper web and 1-5 μm when the roll face is heated directly.

7. The method of claim 1, further comprising applying said coating upon said roll face to a thickness from about 50 μm to about 150 μm.

8. The method of claim 1, wherein said coating has a thickness from about 10 μm to about 10 mm.

9. An arrangement in a paper machine, comprising a roll comprising a roll face having a coating thereon, said coating comprising an inner layer comprising $ZrO_2$ which functions as an insulating layer underneath an outer layer selected from the group consisting of $Al_2O_3$, $SiO_2$, $Na_2O$, $Fe_2O_3$, CaO, MgO, $TiO_2$ $Y_2O_3$, $Cr_2O_3$, and mixtures thereof, an external heating device adapted to heat said roll face in order to dry or detach a paper web running over said roll face, said coating having a sufficient thickness to provide thermal insulation to the roll, such that heat from said external heating device heats said roll face without heating said roll to a depth greater than the roll face.

10. The arrangement of claim 9, wherein said coating has a thickness from about 50 to about 150 μm.

11. The arrangement of claim 10, wherein said external heating device is an infrared heater which applies infrared radiation having a wavelength of 1 μ±0.5 μm when heating takes place through the paper web and 1–5 μmm when the roll face is heated directly.

12. The arrangement of claim 9, wherein said coating has a thickness from about 10 μm to about 10 mm.

* * * * *